United States Patent [19]

Martin

[11] Patent Number: 4,566,581

[45] Date of Patent: Jan. 28, 1986

[54] COIN OPERATED DISPENSERS FOR DISPENSING HORIZONTALLY DISPOSED ARTICLES SUCH AS NEWSPAPERS FROM THE UPPER END OF A STACK

[75] Inventor: Dennis R. Martin, Saginaw, Mich.

[73] Assignee: Draper Technologies, Inc., Saginaw, Mich.

[21] Appl. No.: 532,380

[22] Filed: Sep. 15, 1983

[51] Int. Cl.[4] ..... G07F 11/22

[52] U.S. Cl. ..... 194/248; 221/6; 221/65; 221/240; 221/244

[58] Field of Search ..... 221/6, 65, 240, 241, 221/244, 262, 271, 274, 276; 194/54, 57

[56] References Cited

U.S. PATENT DOCUMENTS

| | | | |
|---|---|---|---|
| 1,946,183 | 2/1934 | Williamson | 221/244 |
| 2,032,278 | 2/1936 | Graillat | 221/244 |
| 2,576,636 | 11/1951 | Opgenorth | 221/244 X |
| 2,653,693 | 9/1953 | Dosberg | 221/244 X |
| 3,263,859 | 8/1966 | Searle | 221/6 X |
| 3,709,405 | 1/1973 | Harris | 221/276 X |
| 4,139,120 | 2/1979 | Moore | 221/244 X |

*Primary Examiner*—F. J. Bartuska

*Attorney, Agent, or Firm*—Learman & McCulloch

[57] ABSTRACT

A coin operated vending machine is provided for delivering the uppermost of a stack of generally horizontally disposed article such as newspapers, out a delivery opening or vending slot. The machine employs an upright pedestal with a top wall for supporting a stack of the articles to be dispensed, and an enclosing cabinet shell is telescopingly received over the upper end of the pedestal and has an article engaging dispensing slot. The pedestal supports the cabinet shell in telescopic position which changes incrementally each time a newspaper is vended. The article is rotated through an arc in the dispensing of the newspaper and a latch bar associated with the dispensing mechanism is movable to latched or unlatched position, dependent on whether or not proper coins have been inserted.

15 Claims, 15 Drawing Figures

COIN OPERATED DISPENSERS FOR DISPENSING HORIZONTALLY DISPOSED ARTICLES SUCH AS NEWSPAPERS FROM THE UPPER END OF A STACK

BACKGROUND OF THE INVENTION

This invention is directed to coin operated vending machines, more particularly to vending machines for dispensing horizontally disposed articles, such as newspapers, magazines, and other articles from the upper end of a stack thereof. Various structures have been disclosed to dispense articles such as newspapers and magazines in the past, and a number of them are disclosed in the following United States patents: Nos.

| | | | |
|---|---|---|---|
| 479,688 | 1,886,694 | 3,709,405 | 3,168,212 |
| 918,639 | 2,904,214 | 3,960,291 | 2,501,434 |
| 1,088,142 | 3,062,406 | 1,817,740 | 3,174,608 |
| 1,216,907 | 3,565,284 | 3,107,770 | 3,265,177 |

For a variety of reasons, the machines proposed for vending one article at a time have not been widely adopted and the newspaper vending machine in widest use today is believed to be the one disclosed in U.S. Pat. No. 3,174,608 in which the newspapers are supported in a generally vertical plane and a coin controlled access door is opened to permit the party who inserted the coins to remove a newspaper. The problem with such vending machines is, of course, that, once access is obtained, the entire stack of newspapers can be removed. Becuase of the considerable variety of money saving coupons which are provided in newspaper advertisements these days, which people need only to clip out of the newspaper and use in a retail store to obtain a considerable discount, or to obtain additional items of the type purchased for no cost, there is an incentive for people to accumulate as many newspapers as possible to obtain these coupons for their own use, or sale to others. Thus, considerable difficulty is now being encountered with vending machines of this type which depend upon the honesty and goodwill of the people using them.

One of the prime objects of the present invention is to provide a vending machine of the type which dispenses only a single article at a time and yet, is of relatively simple construction and thus, is relatively inexpensive to manufacture and maintain. The machine to be described, for instance, avoids the need in previous single article vendors to continuously elevate the stack each time a newspaper or like article has been vended, and accordingly requires no complex mechanism for incrementally raising the stack.

Another object of the invention is to provide a vending machine which has the flexibility to disepnse articles of varying thickness in an efficient and reliable manner, using mechanism which operates simply in a trouble free manner to deliver the newspaper or other article to a vending slot.

Still another object of the invention is to provide a coin operated vending machine whose principles of operation are such that, not only newspapers, but also magazines, books, and other appropriate products for the mechanism claimed can be dispensed utilizing the inventive concepts which will be described.

Another object of the invention is to provide improved and unique vending machines which are extremely difficult to loot and vandalize.

Still another object of the invention is to provide a coin controlled latching mechanism for preventing the operation of the vending machine until the proper coin, of combination of coins, is inserted, the latching mechanism being of simple and uncomplicated construction and operative with mechanism which dispenses the newspaper by rotating it through substantially a 90° arc to a position in which it is exposed in the vending slot and can be pulled the rest of the way out.

Another object is to provide a coin controlled latch bar, which, in a reliable manner, will free the dispensing mechanism for operation when proper coins are inserted in the coin chute.

SUMMARY OF THE INVENTION

A coin operated dispensing machine is provided for delivering the uppermost of a stack of generally horizontally disposed articles out a delivery opening or vending slot. The machine employs an upright cabinet pedestal with a top wall for supporting a stack of the articles to be dispensed, and an enclosing cabinet shell telescopingly received over the upper end of the pedestal which has an article engaging dispensing chute or slot. The pedestal supports the cabinet shell in a telescoping position on the pedestal which changes incrementally each time a newspaper is dispensed. The article engaging member is rotated through an arc in the dispensing of the newspaper and a latch bar associated therewith is movable to latched or unlatched position, dependent on whether or not proper coins have been inserted in the vending machine.

Other objects and advantages of the invention will be pointed out specifically or will become apparent from the following description when it is considered in conjunction with the appended claims and the accompanying drawings wherein:

IN THE DRAWINGS

Figure 1:
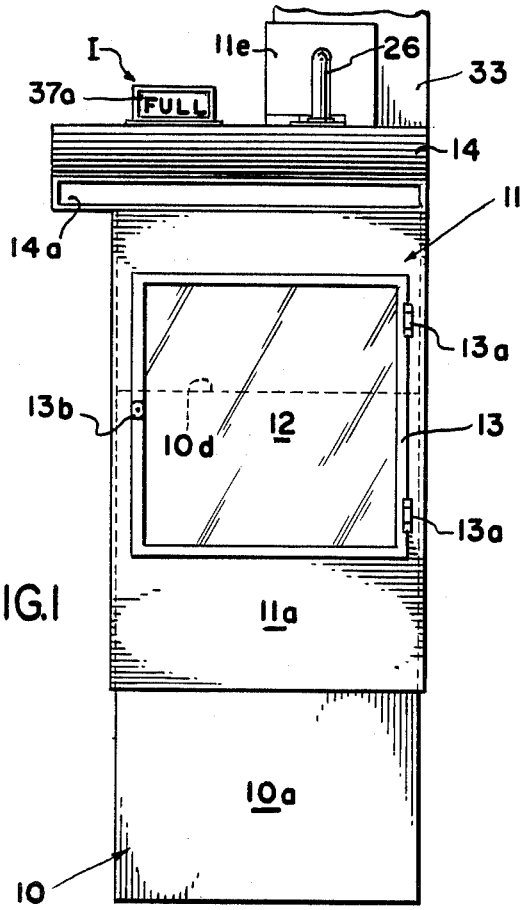
FIG. 1 is a side elevational view of a vending machine constructed in accordance with the invention.

Referring now more particularly to the accompanying drawings, and particularly in the first instance to FIGS. 1–8 thereof, a base cabinet housing pedestal of oblong shape 10 is shown as having front and rear walls 10*a* and 10*b*, side walls 10*c*, and a top wall 10*d* which functions as a support shelf for a stack S of newspaper N, or like articles which the machine will dispense. The base 10 is firmly anchored to the concrete or other surface on which it rests in any suitable well-known manner, or may be chained in position so that it cannot be removed. Sliding telescopically over the upper end of base 10 is an upper casing or cabinet shell generally designated 11, also having a front wall 11*a*, a rear wall 11*b*, side walls 11*c*, and a top wall 11*d*. A window 12 may be set in a door frame 13 in front wall 11*a*, to permit observation of how many newspapers or articles remain in the stack S at any time and, or course, is preferably constructed of a tough nonfracturable material. Door 13 may be mounted on hinges 13*a* at one end and may have a key operated lock 13*b* at its opposite end which releasably secures it to cabinet 11. The upper end of housing 11 is enlarged to provide a dispensing chute 14, having a dispensing or vending opening 14*a* and it will be noted that the inner end of chute 14 is closed by a guard plate 15 (FIG. 4), hinged to wall 11*d* as at 16, in a manner such that access to the interior of the housing 11 is prevented via opening 14*a*. The upper end of plate 15 is spaced a distance 17 above the bottom of chute 14 to permit a single newspaper or like article to be dispensed.

Mounted in a bearing 18 provided on cabinet top wall 11*d*, within a cabinet upward projection 11*e*, is an axially fixed shaft 19, which is suitably prevented from moving axially by thrust collars on the shaft within the bearing structure (not shown) and it will be noted that, at the lower end of shaft 19, an axle 20 is carried which mounts a pair of spaced apart rollers 21 for free rotation thereon, rollers 21 being restrained from moving axially on the axle 20, however.

Also mounted to the lower end of shaft 19 just above the level of axle 20 is a generally bail shaped angular newspaper-article dispensing arm, generally designated A which has an end 22 extending into an opening 19*a* in shaft 19 and mounted for rotation therein. Arm A further has an intermediate section 23 and an outer section 24 on the lower end of which is a dependent vertically inclined disc 25, which, as FIG. 3 indicates, is adapted in a position x to engage bending the folded edge of a newspaper or the like. Arm A assists in moving the article to be dispensed in the path indicated by the broken lines in FIG. 3, from the broken line position indicated at x in which disc 25 is behind the folded over edge of the newspaper over to the position shown in solid lines in FIG. 3, which is the vending position.

Figure 3:
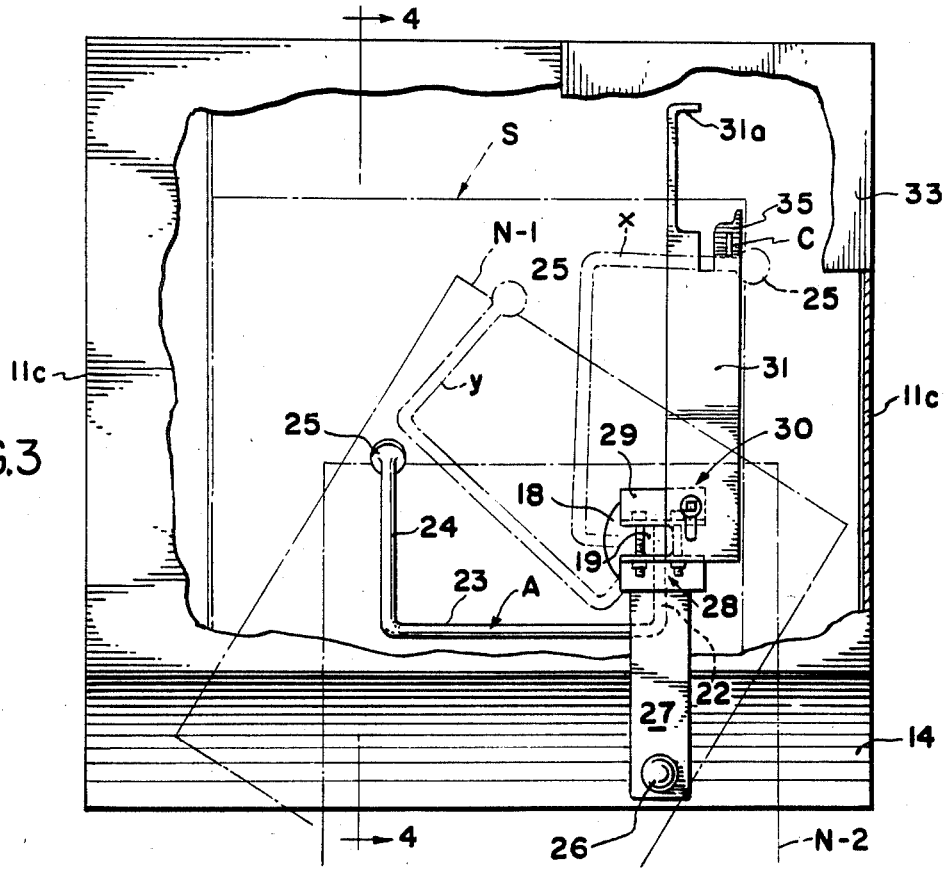
FIG. 3 is a top plan view with a portion of the upper casing broken away to disclose some of the operating mechanism, the chain lines indicating certain positions of the article engaging arm.

The dispensing movement of arm A moves it from position x through an intermediate position y, to reach the position in which it is indicated in solid lines in FIG. 3. In so swinging it helps to revolve the newspaper from a position of vertical orientation with stack S through the position indicated at N-1 to the vending position N-2 in which it has been revolved 90° and protrudes slightly through the mouth 14*a* of the dispensing chute 14, where it can be grasped. The party purchasing the newspaper can then simply grip the end of a newspaper in the N-2 position and pull it the remaining way out of the chute and off the stack. The rollers 21, of course, function to also rotate the top newspaper through the arc about the shaft 19 as an axis. At its upper end, as FIG. 4 indicates, an upstanding operating handle 26 mounted by an operating lever 27 is connected by a bolt and nut assembly 28 to the upper end of shaft 19.

Also connected to the upper end of shaft 19, via bracket 29 and nut and screw assembly 30, is a coin releasing lock bar 31 which leads as shown through an opening 32 in the lower end of a coin box 33 mounted on wall 11*b*. The coin box is of the character disclosed in Knickerbocker U.S. Pat. No. 3,265,177 issued Aug. 9, 1966, which is incorporated herein by reference, and need not further be described. It incorporates a vertically extending coin chute 33*a* formed by front and rear walls 33*b* and 33*c*, and side walls 33*d* to guide a coin C down to the position shown in FIG. 4. Operating handle 26 cannot be swung to move the arm A through its newspaper dispensing movement unless a proper coin C is in this position, and release bar 31 is controlled in a manner to be described to permit the rotary movement of shaft 19. Normally, several coins will be required to deactivate lock bar 31, but, for purposes of simplification, only one coin is illustrated as involved in the operation.

It will be seen that bar 31 has an angularly disposed inner end 31*a* connected with a spring 34 which biases the bar 31 upwardly so that the cam surface 35 provided on bar 31 is normally maintained in engagement with coin C. As described in the patent mentioned, a pivotal stop member 36, to shortly be discussed in more detail, is provided to prevent the coin C from rising in the coin chute 33*a*, once it has fallen into proper position against the cam surface 35. When the coin C is in position, clockwise (FIG. 3) rotation of handle 26 causes bar 31 to move forwardly and it is possible for it to do this because the front portion of the bar 31 is depressed to the 31' position. When surface 35 has moved out of slot 32 the coin C is free to fall (see FIG. 3) to the bottom of coin box 33 in the usual manner. This clockwise rotation of shaft 19 moves the arm A from the position shown in FIG. 3 to the x position, and then rotation of handle 26 in the opposite counterclockwise direction moves it back to the article dispensing position in which it is shown in solid lines in FIG. 3. When the arm A is moved in a clockwise swinging direction to the x position, the disc 25 is supported on the uppermost newspaper, or article, until it moves beyond the end of the article. At this point, the forces of gravity will cause the end 22 of arm A to rotate in opening 19*a* until prevented from doing so further by the inclined portion 24 of arm A. The inclination of arm part 24 relative to the inclination of disc 25, is chosen such that the maximum vertical distance z is controlled and disc 25 will engage behind only the topmost newspaper N. The fact that the newspapers will, from day to day, be of different thickness does not disturb the operation of the machine.

Each time a newspaper is vended, the cabinet 11 will descend on cabinet pedestal 10 an increment corresponding to the thickness of the newspaper dispensed, until finally disc 25 rests on platform 10*d*. The stack S, while shown as of relatively limited height in the drawings, is, in practice, usually of such vertical extent that the entire supply of newspaper or articles may not be depleted on a daily basis. Reloading of the stack of newspapers occurs by unlocking and swinging the door 13 outwardly, and, of course, any newspapers remaining from the day before are removed first of all.

Figure 4:
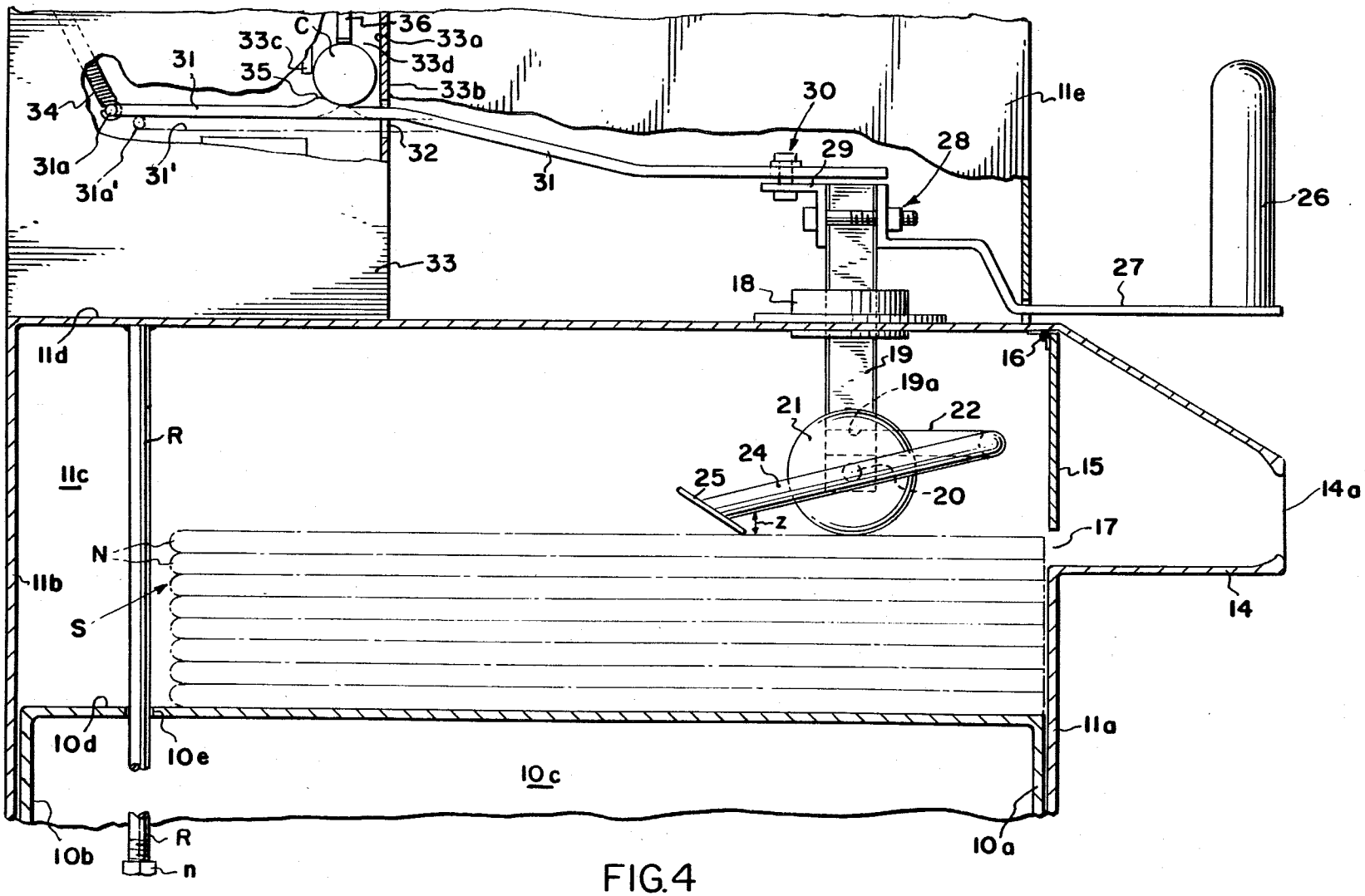
FIG. 4 is an enlarged, fragmentary sectional side elevational view taken on the line 4—4 of FIG. 3.
Figure 5:
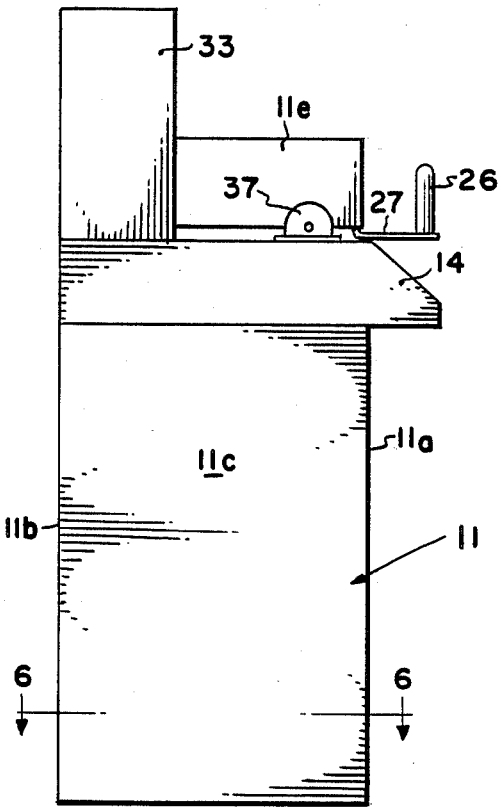
FIG. 5 is a side elevational view of the vending machine.
Figure 6:
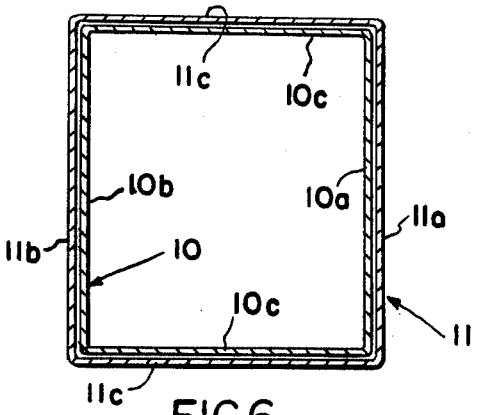
FIG. 6 is a sectional plan view taken on the line 6—6 of FIG. 5.
Figure 7:
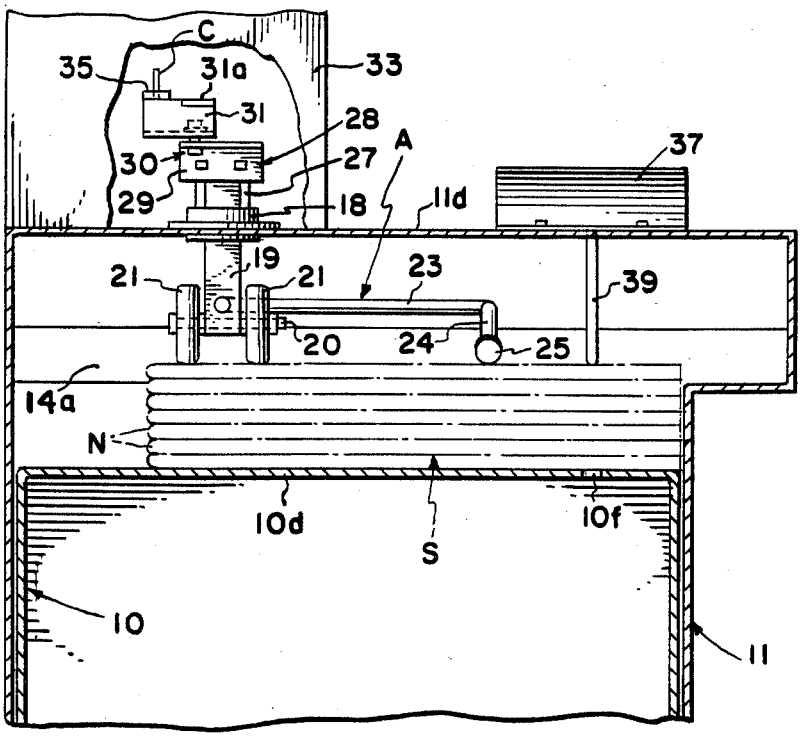
FIG. 7 is an enlarged fragmentary sectional end elevational view further illustrating the dispensing arm structure.

Any suitable manner of securing the upper cabinet 11 to the lower cabinet pedestal 10, may be employed which will permit the relative incremental telescoping described after each vending operation. In FIG. 4, a rod R which extends through an opening 10*e* in top shelf 10*d* is shown as welded to the cabinet top wall 11*d*. A nut n is provided on the rod to prevent separation of the cabinet 11 from the pedestal 10. Obviously, a plurality of such rods may be employed.

Figure 2:
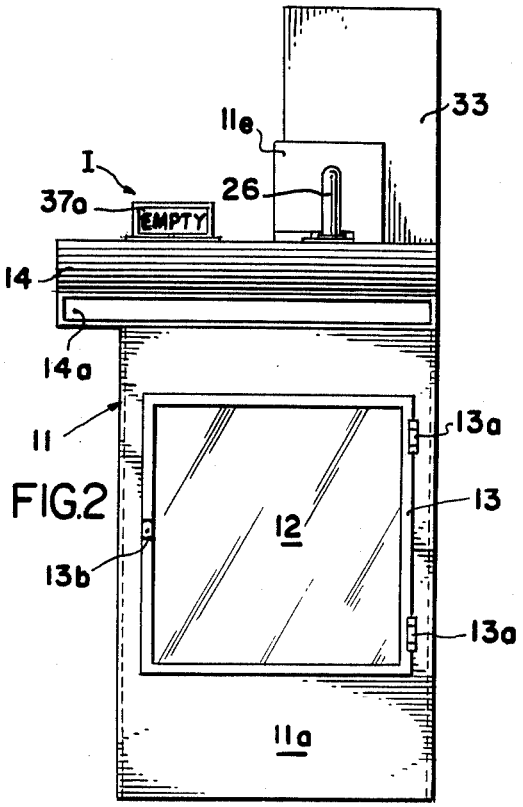
FIG. 2 is a similar view of the upper portion only.
Figure 8:
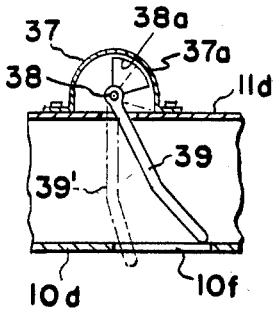
FIG. 8 is an enlarged sectional, elevational view of the indicator mechanism which can be employed.

An indicator box I which indicates "full" or "empty", as indicated in FIGS. 1 and 2, respectively, is also provided and is more particularly illustrated in FIG. 8. The indicator I comprises a semi-circular housing 37 having a window opening 37*a* provided therein. A shaft 38, journaled in the ends of the casing 37, has a dependent rod 39 in alignment with a slotted opening 10*f* in wall 10*d*. Normally, the newspaper stack S holds the member 39 in the up position indicated in solid lines in FIG. 8, such that the slot 10*f* remains covered. When, however, the cabinet 11 has descended incrementally far enough so that disc 25 rests on the surface 10*d*, and no newspapers remain, then gravity forces will cause leg 39 to assume the 39′ position shown in FIG. 8. Provided on shaft 38 to rotate past window 37*a* is an arcuate display plate 38*a*, having the word "empty" printed above the word "full". So long as the leg 39 is in the position shown in solid lines, the "full" portion is displayed, but when the last newspaper is removed and leg 39′ assumes the broken line position, shaft 38 will rotate carrying the arcuate plate 38*a* clockwisely (in FIG. 8) with it such that the "empty" section is displayed.

FIGS. 9–15 show an improved form of the invention described and, for purposes of convenience, I have used like numbers in these Figures to describe the common parts. It will be noted that the former handle 26 and crank arm 27 have been replaced by a push-pull arm 40. Mounted on shaft 19 is a crank arm 41 having an opening 42 in which the angularly downturned end 40*a* of rod 40 is loosely received such that movement of rod 40 is transmitted to shaft 19.

Figure 10:
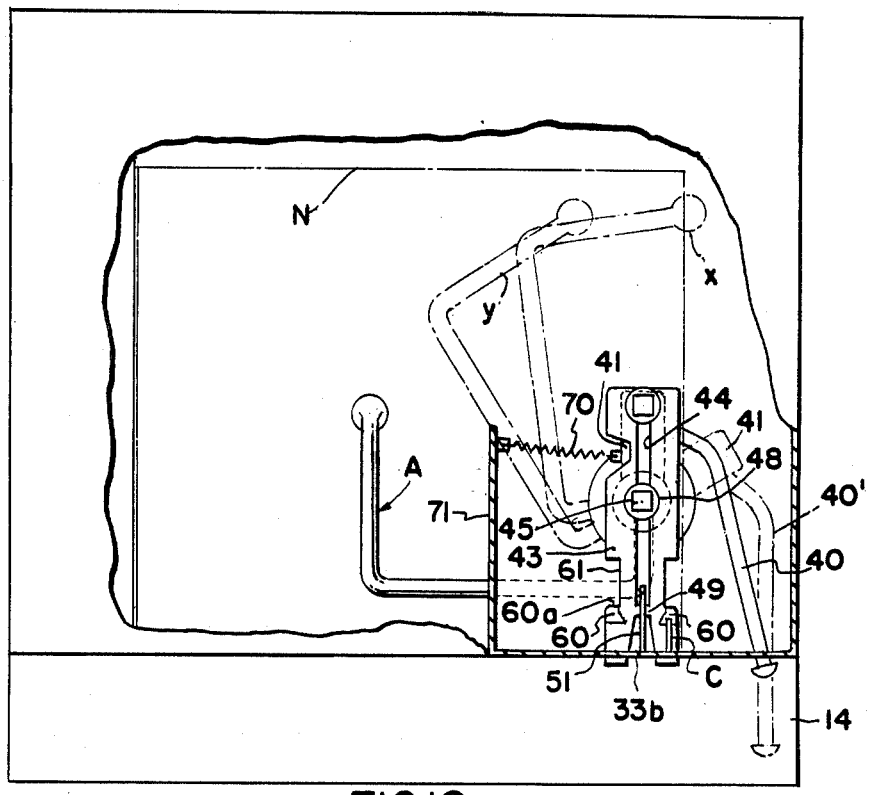
FIG. 10 is a top plan view thereof, with a portion of the upper casing broken away to illustrate the mechanism and various positions of the dispensing arm.

At its upper end, shaft 19 is formed with a flat surface 19*a* on which a lock bar or plate 43 is slideably received. Plate 43 has a slot 44, as shown in FIG. 10, passing a bolt 45 which threads centrally into an opening 46 in the upper end of shaft 19. A spring 47 is provided in compression around the bolt 45, between the head thereof and a washer 48 which rests on plate 43 and bridges the slotted opening 44 therein. Normally, spring 47 operates to bear against washer 48 and maintain it flat against plate 43, which thus is maintained flat against the upper end of shaft 19. Thus, under the action of spring 47, plate 43 is normally maintained in a horizontal position.

In this horizontal position, a bridge or lock wall 49 which spans the slot 44 is in position to abut against and be latched by (see FIG. 15) a dependent detent latch 50 to prevent further outward or forward movement of lock plate 43. The latch 50 is part of a member 51 fixed to the front wall 33*b* of the coin mechanism box 33, which has dependent cam surfaces 51*a* and 53 provided for purposes which will later be described.

At its rear end, the plate 43 is pivotally connected by an L-shaped rod 54 to the arm 41, the rod 54 having a downturned end 54*a* loosely received in an opening 55 provided in arm 41. A nut and washer assembly generally designated 56 is provided to connect the opposite end of arm 54 to the plate 43, a lower washer 57 to which this end of arm 54 is welded having an opening for receiving a threaded stud 58. Washer 57 may be vertically retained by a cotter pin 59 as shown. The mounting of arm 54 is such that it can move vertically with respect to the stud 58 and opening 55 in order to provide for some tilting movement of lock release plate 43. The fixed latch member 51 is centrally disposed on wall 33*a* such that its lower end is received within the slot 44 in position to engage bridge wall 49.

Provided on plate 43 at a spaced distance rearwardly from the front end thereof are a pair of upstanding inclined cam members 60 (see FIGS. 9 and 10) which terminate as shown at point 60*a*. While not shown, a pair of coin chutes 33*a* are provided because Sunday newspapers are normally more expensive than daily newspapers and these chutes vertically align with the cams 60 so that coins in the lower end will engage either of the cams 60. For purposes of convenience of illustration, it will be assumed that the coin chute 33*a* shown aligns in the front to rear direction with the right-hand cam member 60 in FIG. 10. Rearwardly thereof the plate 43 has cut-out portions 61 of a size to permit a coin C to fall through to a coin receiver R provided in the coin box housing underneath.

Figure 11:
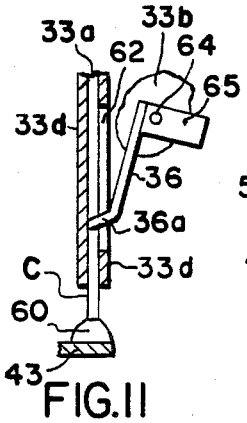
FIG. 11 is an enlarged, fragmentary sectional view illustrating the mechanism for preventing a coin from rising in the coin chute once it is in position.
Figure 9:
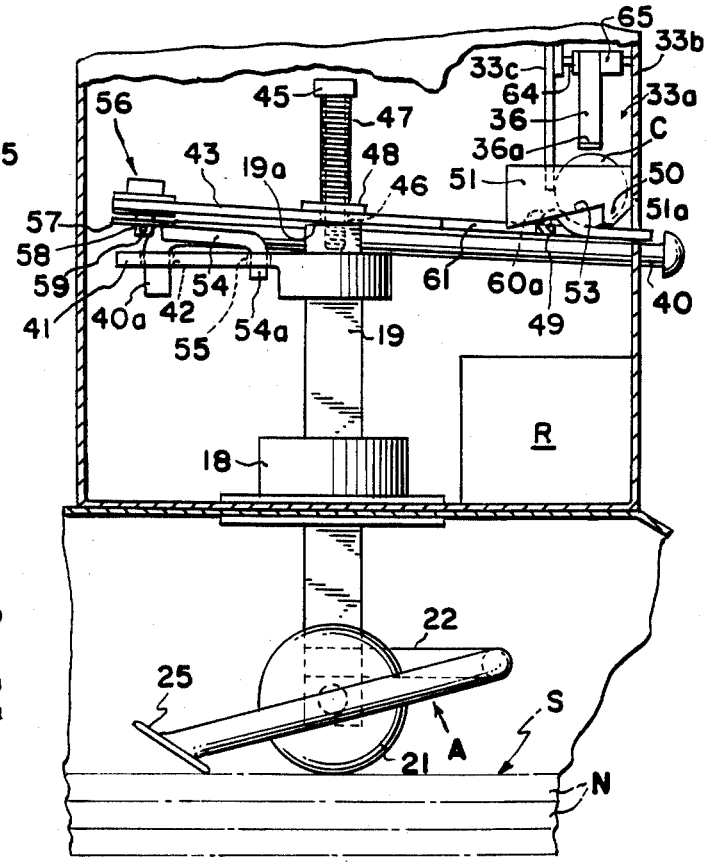
FIG. 9 is a view similar to FIG. 4 but illustrating a modified embodiment of the invention in which the coin controlled lock bar takes a different form.
Figure 12:
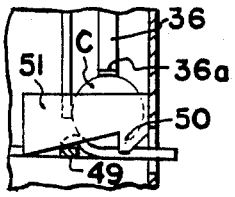
FIG. 12 is an enlarged, fragmentary elevational view showing a coin in position and the device ready to be operated.
Figure 13:
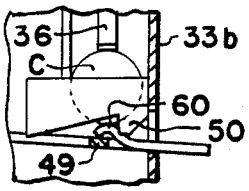
FIG. 13 is a further view showing the manner in which the coin unlocks the release bar.
Figure 15:
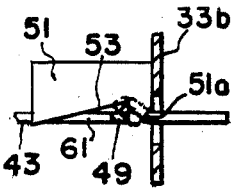
FIG. 15 shows the manner in which the release bar is locked, when no coin is present.
Figure 14:
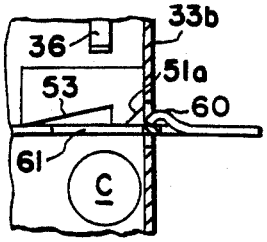
FIG. 14 is a view showing the coin falling into the coin receiving chute.

As in the FIG. 4 embodiment, a detent arm 36 automatically moves in position (see FIG. 11) through a slot 62 provided in the coin chute 33*a* to prevent upwardly movement of the coin C beyond a predesignated point, once the coin is dropped through the coin chute 33*a* to the position shown in FIGS. 4 or 9. Arm 36 is pivotally mounted as in the patent mentioned earlier as at 64 by the coin box casing and has an angled end 36*a*. It will be noted that the upper end of arm 36 has a weight 65 integrated with it, such that the normal position of arm 36 is as shown in FIG. 11. When a coin is dropped into the coin slot 33*a*, its weight moves the arm 36 outwardly through the opening 62 such that the coin is permitted to fall to the position shown in FIGS. 4 or 9. The counterweighted portion 65 then is responsible for swinging the arm back into position above the coin and clearly the coin is prevented then from moving upwardly in coin slot 33*a*. While only one coin has been shown in these drawings for convenience of illustration, clearly multiple coins will usually be involved in obtaining a newspaper. They are disposed one on top of another, in the manner disclosed in the aforementioned patent. A return spring 70 can be connected between a bracket 71 extending from cabinet 11 and the crank arm 41 to restore the arm A to the solid line position illustrated in FIG. 10.

In the operation of the second embodiment described, it will be assumed that the operating rod 40 is normally in the position in which it is shown in solid lines in FIGS. 9 and 10. In this position, the bridge piece 49 is rearward of the latch part 50 and surface 53 is keeping it from being moved further upwardly under the action of spring 47, which tends to want to keep the plate 43 in horizontal position, flat against the surface 19*a*. It will also be assumed that a coin C is in the position indicated in FIGS. 9 and 10. If a coin were not present, outward movement of rod 40, and accordingly of lock release plate 43 would free the plate 43 and its lock bridge 49 to move further upwardly until it engaged with the latch 50. It is through the cranks 41 and 54 that motion of the rod 40 is transmitted to shaft 19 and plate 43.

Initial outward movement of rod 40 swings arm A clockwisely in FIG. 10 and moves plate 43 forwardly.

When the arm A has reached the y position, plate 43 has been permitted to move upwardly by cam surface 53 such that the latch members 49–50 would latch, if no coin C were present. With a coin C present, however, the lock does not occur. The initial outward or forward movement of plate 43 provides some slight raising movement of coin C to the FIG. 12 position in which the arm 36 positively prevents its further upward movement. Thus, further forward movement of plate 43 will cause the coin to ride up cam surface 60 and depress the plate 43 against the action of spring 47 so that plate 43 will be tilted relative to the surface 19*a* of shaft 19. The plate 43 is depressed by the coin C far enough so that bridge 49 rides forwardly beyond latch 50 in a lowered position (FIG. 13), and, in fact, forwardly far enough that the slot 61 is beneath the coin C, and the coin C can fall to the open end of the coin receiver R. As the push rod 40 is moved further forwardly, the arm A is free to be swung to the x position, to engage behind the page folded-over end of the uppermost newspaper or article N. When the rod 40 is now pushed inwardly, the arm A is swung through 90°, and dispenses a newspaper in the manner previously described. When the inward or rearward movement of rod 40 is transmitted to plate 43, the lock bridge 49 rides down the cam surface 51*a* and is free to pass rearwardly of detent 50 to original position. Because cam surface 53 will eventually depress plate 43, in the FIGS. 9–10 position, a coin is free to fall to the position shown below arm 36.

While not shown, the coin box mechanism incorporates suitable coin return mechanism, and Knickerbocker U.S. Pat. No. 3,265,177 discloses typical mechanism for accomplishing a coin return.

While one embodiment of the invention has been described in detail, it will be apparent to those skilled in the art that disclosed embodiments may be modified. Therefore, the foregoing description in all aspects is to be considered exemplary rather than limiting in any way, and the true scope of the invention is that defined in the following claims.

What is claimed is:

1. In a coin operated dispensing machine for delivering the topmost of a stack of generally horizontally disposed articles, such as newspapers, out a delivery opening; an enclosing cabinet shell, having side and top walls with a vending slot in a side wall; stack support means within said shell for supporting successive topmost articles in the stack opposite the slot; an article engaging shoe depending from the shell to engage the uppermost article in the stack; actuating mechanism supported by said shell and associated with said shoe for moving a topmost article in a horizontal path of travel from a position oriented with the stack over to said vending slot; coin controlled mechanism interconnecting with said actuating mechanism and interactable with it when the proper coins have been inserted to permit said actuating mechanism to vend the article; said shoe comprising at least one roller; said cabinet shell being oblong in cross section and having a pair of longer front and rear side walls joined by shorter end walls, said vending slot being in said front wall; and vertical shaft means oscillatable arcuately about a vertical axis mouned to position said roller at one side of and adjacent said slot above the corner portion of said support surface such as to engage a corner of the topmost article of the stack offset from the vertical center thereof; said coin controlled mechanism including an operating element connected with said shaft and movable when operatively freed to pivot said shaft means and roller through substantially a 90 degree arc to swing the topmost article through substantially a 90 degree arc to deliver it endwisely into said slot.

2. The machine of claim 1 wherein a generally horizontally disposed arm having a dependent member for engaging behind the end edge of the topmost article is mounted by said shaft means above the roller to swing therewith.

3. The machine of claim 1 wherein an axle mounts a pair of freely rotatable, spaced apart rollers on the lower end of said shaft means.

4. The machine of claim 1 wherein said operating element comprises a crank arm assembly, connected with said shaft means having a portion extending out of said cabinet shell to be grasped by the machine operator; and said coin controlled mechanism further includes lock means preventing the operation of said crank arm assembly except when the proper coins are in place.

5. The machine of claim 2 wherein the arm is U-shaped and includes a horizontal leg pivotally received by said shaft means to swing the arm vertically about a horizontal axis, said arm having an opposite inclined leg extending downwardly at a vertically inclined angle which has an article engaging shoe provided at the free end thereof.

6. The machine of claim 5 wherein said shoe is an inclined disc set at a prearranged angle to the inclination of said inclined leg.

7. The machine of claim 4 wherein said lock means includes a coin release bar mounted to be movable in a back and forth path and connected to said shaft means, a coin chute is provided for receiving a coin or coins and has an open lower end normally blocked by the coin release bar such as to receive a coin in place, thereon, the chute having means permitting the coin or coins to fall to the release bar while blocking their upward movement in the chute; a fixed latch surface normally interacting with the bar; and means on said bar for moving it out of alignment with said latch surface when the bar is moved by the shaft means and a proper coin, or coins, are in place.

8. The machine of claim 1 wherein said coin controlled mechanism incorporates a coin chute; stop means associated therewith is operative to permit proper coins to move down to the lower end of said chute but prevent them substantially from moving upwardly once they are such that said coins can serve as an upward movement blocker; a coin released bar is connected with said shaft means and mounted by said coin controlled mechanism for back and forth movement in a generally planar path, the bar having a lock part interactable normally with a fixed lock on said coin controlled mechanism in the planar path of said bar; resilient means normally biasing said bar to move in said planar path but permitting it to be displaced out of said path to pass the lock part beyond said fixed lock part when said bar engages a proper coin in the lower end of said chute; and a manually graspable operating element connected to oscillate said shaft means to vend the article when permitted to do so by said bar.

9. The machine of claim 8 in which said bar and manually graspable element both have a crank arm connection with said shaft means.

10. The machine of claim 8 in which upstanding cam means on said bar is provided at a predetermined location thereon such as to be intractable with the lowermost coin in said chute to force said bar downwardly out of said planar path and out of a position in which said lock part could engage said fixed lock.

11. The machine of claim 1 in which a ground supported upright pedestal has a vertically fixed top wall surface constituting said stack support means, and an enclosing cabinet shell having side and top walls with a vending slot in a side wall is telescopically received over the upper end of said pedestal; and indicator means is mounted to be visible outside the machine, said indicator means carrying a movable indicator to react with telescoping movement of the shell of the pedestal and indicating when the stack is depeleted.

12. The machine of claim 11 in which a recess is provided in the top wall of the stack support top wall surface which normally is covered by the stack; the movable indicator including an operating element positioned to normally enter the recess except when prevented by an article in the stack from doing so.

13. In a coin operated dispensing machine for delivering the topmost of a stack of generally horizontally disposed articles, such as newspapers to a delivery opening; an enclosing cabinet shell, having side and top walls with a vending slot in a side wall and a stack support surface for a stack of said articles; a generally vertically disposed rotary shaft incorporating an article engaging shoe depending from the shell to engage the uppermost article in the stack; an operating element mechanism supported by said shell and connected with said shaft for rotating the shaft and shoe, and moving a topmost article in a horizontal arcuate path of travel from a position oriented with the stack over to said vending slot; a vertically extending coin chute; a coin controlled latch bar, associated therewith to be released when a proper coin or coins are deposited in the chute and unlatch when the proper coins have been inserted to permit said operating element mechanism to rotate said shaft and vend the article, said shoe including an arm having one end horizontally received by said shaft and a second end extending vertically downwardly relative thereto and having a projecting member thereon for locking over the end of the article; and roller means mounted for rotation on the lower end of said shoe.

14. In a coin operated newspaper and like article vending machine for dispensing articles on a one-at-a-time basis:

a. a housing forming a cabinet for containing a vertical stack of horizontally disposed newspapers having front, rear and side edges, and like articles to be vended;

b. wall means incorporated with the housing providing a dispensing slot for passing one article at a time laterally out from the top of said stack;

c. means for supporting successive articles in the stack with their front edges opposite the dispensing slot;

d. dispensing elements actuable to engage the uppermost article in the stack and move one side edge of the topmost article at least partly out the opening comprising a fulcrum shoe mounted to rotate about its own generally vertical axis of rotation and having a projecting arm mounted for swinging travel in generally a 90 degree arc about said axis in generally a horizontal plane;

e. generally vertical pivot means providing said generally vertical axis, mounted on said housing inward of said slot above a front corner portion of said support means and the articles supported thereon, and supporting the fulcrum shoe for rotation about said axis;

f. a fulcrum surface for said shoe at said axis depending to engage the topmost newspaper on said platform at a front corner thereof;

g. an article edge-engaging claw mounted by said arm at a spaced distance inwardly from said axis and fulcrum surface for movement in sliding engagement with the topmost article and for vertical downward movement when it has cleared the topmost article in its return travel to a position facing the other side edge thereof near the rear edge thereof;

h. operating linkage operable to swing said arm substantially about the fulcrum surface and turn said claw through generally 90 degrees of travel to turn a topmost article disposed broadside on said support means to generally an endwise position projecting out said slot; and i. coin controlled latch means normally preventing operation of said linkage except when proper coins are inserted.

15. In a coin operated newspaper and like article vending machine for dispensing articles on a one-at-a-time basis:

a. a housing forming a cabinet for containing a vertical stack of horizontally disposed newspapers having front, rear and side edges, and like articles to be vended;

b. wall means incorporated with the housing providing a dispensing slot for passing one article at a time laterally out from the top of said stack;

c. means for supporting successive articles in the stack in a broadside position with their front edges facing the dispensing slot;

d. dispensing elements actuable to engage the uppermost article in the stack and move one side edge of the topmost article at least partly out the opening comprising a fulcrum shoe mounted to rotate about its own generally vertical axis of rotation and having a projecting arm mounted for swinging travel about said axis in generally a horizontal plane;

e. generally vertical pivot means providing said generally vertical axis, mounted on said housing inward of said slot above a corner portion of said support means and the articles supported thereon, and supporting the fulcrum shoe for rotation about said axis;

f. a curvilinear fulcrum surface on the lower end of said shoe depending to engage the topmost newspaper on said platform at a corner thereof;

g. an article edge-engaging claw mounted by said arm at a spaced distance inwardly from said axis and fulcrum surface for movement in sliding engagement with the topmost article and for vertical downward movement when it has cleared the topmost article in its return travel to a position facing an edge of the article;

h. operating linkage operable to swing said arm substantially about the fulcrum surface and turn said claw to turn a topmost article disposed broadside on said support means to generally an endwise position projecting out said slot; and i. coin controlled latch means normally preventing operation of said linkage except when proper coins are inserted.

* * * * *